United States Patent [19]

Altavela et al.

[11] Patent Number: 4,585,320

[45] **Date of Patent: * Apr. 29, 1986**

[54] CORONA GENERATING DEVICE

[75] Inventors: Robert P. Altavela, Rochester; Raymond E. Bailey, Webster; Joan R. Ewing, Fairport; Edwin M. Wallin, Penfield, all of N.Y.

[73] Assignee: Xerox Corporation, Stamford, Conn.

[ * ] Notice: The portion of the term of this patent subsequent to Apr. 29, 2003 has been disclaimed.

[21] Appl. No.: 680,861

[22] Filed: Dec. 12, 1984

[51] Int. Cl.[4] ..... G03G 15/00

[52] U.S. Cl. ..... 355/3 CH; 250/325; 250/326; 361/212; 430/902

[58] Field of Search ..... 430/902; 355/3 CH, 14 CH; 55/74, 387; 361/212; 250/324, 325, 326

[56] References Cited

U.S. PATENT DOCUMENTS

| | | | |
|---|---|---|---|
| 2,574,225 | 11/1951 | Ringk et al. | 204/38 |
| 2,813,804 | 11/1957 | Kendall et al. | 117/130 |
| 2,836,725 | 5/1958 | Vyverberg | 250/49.5 |
| 3,862,420 | 1/1975 | Banks et al. | 250/324 |
| 4,086,650 | 4/1978 | Davis et al. | 361/229 |
| 4,265,990 | 5/1981 | Stolka et al. | 430/59 |
| 4,318,610 | 3/1982 | Grace | 355/14 D |

OTHER PUBLICATIONS

"Electroless Plating Today", *Metal Finishing* pp. 45–49, and 52, Author–Edward B. Saubestre, Aug. 1962.

Research Disclosure–Nov. 1980, p. 508, Item 19957 "Corona Discharge Unit".

Defense Publication T940022, Pressurized & Filtered Xerographic System–Rodda–Pub., Nov. 4, 1975.

*Primary Examiner*—Arthur T. Grimley
*Assistant Examiner*—David Warren
*Attorney, Agent, or Firm*—Samuel E. Mott, III

[57] ABSTRACT

A corona generating device for depositing negative charge on an imaging surface carried on conductive substrate comprises at least one elongated conductive corona discharge electrode, means to connect the electrode to a corona generating potential source, at least one element adjacent the corona discharge electrode capable of adsorbing nitrogen oxide species generated once the corona generating electrode is energized and capable of desorbing nitrogen oxide species once that electrode is not energized, the element being plated with a substantially continuous thin layer of lead to neutralize the nitrogen oxide species when generated. In a preferred embodiment the corona discharge electrode comprises a thin wire coated at least in a discharge area with a dielectric material and the at least one element comprises a conductive shield and an insulating housing having two sides adjacent the shield to define the longitudinal opening to permit ions emitted from the electrode to be directed toward a surface to be charged, both the shield and the two sides of the housing being plated with a substantially continuous thin layer of lead.

13 Claims, 3 Drawing Figures

CORONA GENERATING DEVICE

REFERENCE TO RELATED APPLICATIONS

Reference is hereby made to copending application Ser. No. 680,867, entitled Corona Generating Device in the name of Joan R. Ewing filed concurrently herewith and to Ser. No. 680,879, now abandoned entitled Corona Generating Device in the name of Louis Reale filed concurrently herewith refiled as continuation-in-part 703,971, filed Feb. 21, 1986.

BACKGROUND OF THE INVENTION

The present invention relates generally to charging devices and in particular to charging devices which produce a negative corona.

In an electrostatographic reproducing apparatus commonly used today, a photoconductive insulating member may be charged to a negative potential, thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development the toner particles are attracted from the carrier particles by the charge pattern of the image areas on the photoconductive insulating area to form a powder image on the photoconductive area. This image may be subsequently transferred to a support surface such as copy paper to which it may be permanently affixed by heating or by the application of pressure. Folowing transfer of the toner image to the support surface the photoconductive insulating surface may be discharged and cleaned of residual toner to prepare for the next imaging cycle.

Various types of charging devices have been used to charge or precharge photoconductive insulating layers. In commercial use, for example, are various types of corona generating devices to which a high voltage of 5,000 to 8,000 volts may be applied to the corotron device thereby producing a corona spray which imparts electrostatic charge to the surface of the photoreceptor. A recently developed corona charging device is described in U.S. Pat. No. 4,086,650 to Davis et al., commonly referred to in the art as a dicorotron wherein the corona discharge electrode is coated with a relatively thick dielectric material such as glass so as to substantially prevent the flow of conduction current therethrough. The delivery of charge to the photoconductive surface is accomplished by means of a displacement current or capacitive coupling through the dielectric material. The flow of charge to the surface to be charged is regulated by means of a DC bias applied to the corona shield. In operation an AC potential of from about 5,000 to 7,000 volts at a frequency of about 4 KHz produces a true corona current, and ion current of 1 to 2 milliamps. This device has the advantage of providing a uniform negative charge to the photoreceptor. In addition, it is relatively low maintenance charging device in that it is the least sensitive of the charging devices to contamination by dirt and therefore does not have to be repeatedly cleaned.

In the dicorotron device described above the dielectric coated corona discharge electrode is a coated wire supported between insulating end blocks and the device has a conductive auxiliary DC electrode positioned opposite to the imaging surface on which the charge is to be placed. In the conventional corona discharge device, the conductive corona electrode is also in the form of an elongated wire connected to a corona generating power supply and supported by end blocks with the wire being partially surrounded by a conductive shield which is usually electrically grounded. The surface to be charged is spaced from the wire on the side opposite the shield and is mounted on a conductive substrate.

In addition to the desirability to negatively charge one type of photoreceptor it often is desired to provide a negative precharge to another type photoreceptor such as a selenium aloy prior to its bein actually positively charged. A negative precharging is used to neutralize the positive charge remaining on the photoreceptor after transfer of the developed toner image to the copy sheet and cleaning to prepare the photoreceptor for the next copying cycle. Typically in such a precharge corotron a AC potential of between 4,500 and 6,000 volts rms at 400 to 600 Hz may be applied. A typical conventional corona discharge device of this type is shown generally in U.S. Pat. No. 2,836,725 in which a conductive corona electrode in the form of an elongated wire is connected to a corona generating AC voltage.

It has been found that when using corona discharge devices that produce a negative corona, certain difficulties may be observed. It is beleived that various nitrogen oxide species are produced by the corona and that these nitrogen oxide species are adsorbed by solid surfaces. In particular it is believed that these oxide species are adsorbed by the conductive shield as well as the housing of the corona generating device. The shield may in principle be made from any conductor but is typically made from aluminum and the housing may be made from any of a number of structural plastics such as a glass filled polycarbonate. This adsorption of nitrogen oxide species occurs despite the fact that during operation the corona generating device may be provided with a directed air flow to remove the nitrogen oxide species as well as to remove ozone. In fact during the process of collecting ozone the air flow may direct the nitrogen oxide species to an affected area of the charging device or even some other machine part. It has also been found that after such exposure when a machine is turned off for extended periods of idleness that the adsorbed nitrogen oxide species gradually are desorbed, that is the adsorption is a physically reversible process. Then, when the operation of the machine is resumed, a copy quality defect is observed in the copies produced in that a line image deletion or lower density image is formed across the width of the photoreceptor at that portion of its surface which was at rest opposite the corona generating device during the period of idleness. While the mechanism of the interaction of the desorbed nitrogen oxide species and the photoreceptor layers is not fully understood, it is believed that they in some way interact with the surface of the photoreceptor increasing the lateral conductivity so that it cannot retain a charge in image fashion to be subsequently developed with toner. This basically causes narrow line images to blur or to wash out and not be developed as a toner image. This defect has been observed with conventional selenium photoreceptors which generally comprise a conductive drum substrate having a thin layer of selenium or alloy thereof vacuum deposited on its surface as the imaging surface. The difficulty is also perceived in photoreceptor configuration of plates, flexible belts, and the like, which may include one or more photoconductive layers in the supporting substrate. The supporting substrate may be conductive or may be coated with a conductive layer over which photoconductive layers may be coated. Alternatively, the multilayered electroconductive imaging photoreceptor may comprise at least two electrically operative layers, a photogenerating layer or a charge generating layer and a charge transport layer which are typically applied to the conductive layer. For further details of such a layer attention is directed to U.S. Pat. No. 4,265,990. In all these varying structures several of the layers may be applied with a vacuum deposition technique for very thin layers.

Furthermore with prolonged exposure of the photoreceptor to the desorbing nitrogen oxide species during extended periods of idleness the severity of the line defect or line spreading increases. While the mechanism is not fully understood it has been observed that even after a relatively short period of time, 15 minutes, and a period of idleness of, say, several hours, a mild line defect and concurrent image deletion may be perceived. During the initial stage of exposure of the photoreceptor to the desorbing nitrogen oxide species, it is possible to rejuvenate the photoreceptor by washing with alcohol since reaction between the photoreceptor and the nitrogen oxide species is purely at the surface. However after a prolonged period of time the reaction tends to penetrate the photoreceptor layer and cannot be washed off with the solvent. Thus, for example, the problem is perceived after a machine has been operated for about 10,000 copies, rested overnight and when the operator activates the machine the following morning, the line deletion defect will appear. As indicated above the defect is reversible to some degree by a rest period. However, the period involved may be of the order of several days which to an operator is objectionable.

Similar difficulties are encountered in a precharge corotron with a negative DC potential applied. Attempts to solve that problem by nickel plating the corotron shield met with limited success in that nickel combined with the nitrogen oxide species forming a nickel nitrate which is a deliquescent salt and on continued use becomes moist with water from the air eventually accumulating sufficient water that droplets may form and drop off onto the photoreceptor. Furthermore the nickel nitrate salts are green crystalline and loosely bonded rather than a cohesive durable film. In another attempt to solve a similar difficulty in a negative charging AC dicorotron device the shield is coated first with a layer of nickel that is subsequently plated with gold. However as a result of the extreme expense of gold, the gold is plated in a very thin layer and consequently the layer is discontinuous having numerous pores in the layer. Gold plating is theorized to provide a relatively inert surface which will not adsorb the nitrogen oxide species. However with the thin porous layer of gold, the nickel substrate underneath the gold corrodes forming nickel nitrates in the same manner as with the precharge corotron and experiences similar difficulties resulting in limited useful life.

PRIOR ART

Item No. 19957 in the Research Disclosure Journal of November 1980 at page 508 describes an electrophotographic copying machine having corona charging unit wherein the ions generated from the corona discharge can interact with the photoconductive member and the conductive housing to form salts, e.g. nitrates which during an overnight period of rest may have a detrimental effect on the part of the stationary photoconductive member opposite the opening to the charging unit. This detrimental effect is claimed to be overcome by coating the inner side of the housing with a cellulose acetate butyrate copolymer in which carbon black particles have been dispersed.

SUMMARY OF THE INVENTION

In accordance with the present invention a corona generating device for depositing a negative charge on an imaging surface is provided wherein the damaging nitrogen oxide species generated by the corona generated by the corona charging unit and adsorbed by at least one element of the corona charging device adjacent the corona discharge electrode during operation and desorbed when at rest, are neutralized.

In accordance with a principle aspect of the present invention, the element which adsorbs and desorbs the nitrogen oxide species is plated with a substantially continuous thin layer of lead to neutralize the nitrogen oxide species when they are generated.

In a further aspect of the present invention, the element which adsorbs and desorbs the nitrogen oxide species comprises a conductive shield which substantially surrounds the corona discharge electrode and has a longitudinal opening therein to permit ions emitted from the electrode to be directed toward the surface to be charged.

In a further aspect of the present invention, the corona discharge electrode comprises a thin wire coated at least in the discharge area with a dielectric material.

In a further aspect of the present invention, the corona generating device comprises a planar shield and includes an insulating housing having two sides adjacent such shield to define a longitudinal opening to permit ions emitted from the electrode to be directed toward the surface to be charged. The two sides of the insulating housing as well as a conductive shield are plated with a substantially continuous thin layer of lead.

In a further aspect of the present invention, a power supply means is supplied for applying an AC corona generating voltage to the corona discharge electrode and for providing a DC potential between the substrate to be charged and the conductive shield.

In a further aspect of the present invention, the plated layer of lead is at least 0.5 mils in thickness on the shield and on two side of the insulating housing.

For a better understanding of the invention as well as other aspects and further features thereof, reference is had to the following drawings and descriptions.

DESCRIPTION OF THE PREFERRED EMBODIMENTS

Figure 1:
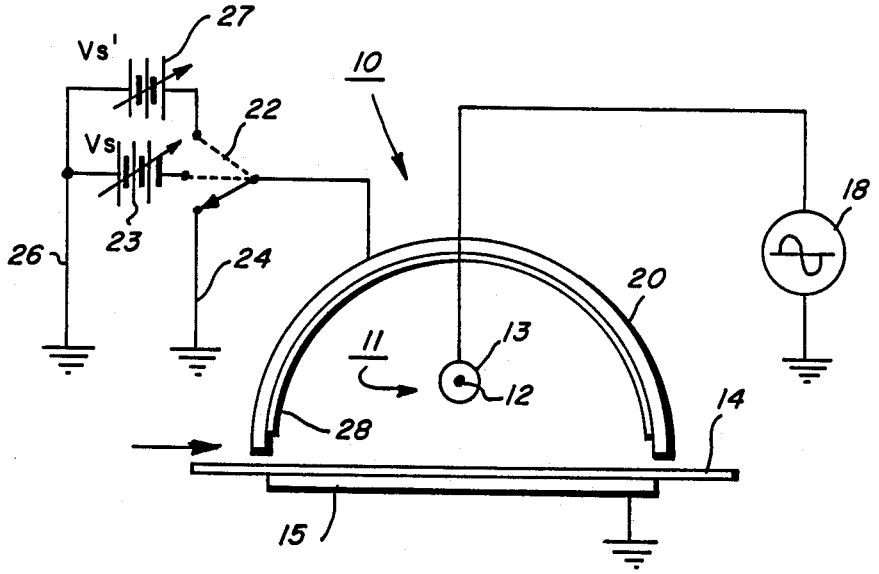
FIG. 1 is an illustrative cross section of a corona discharge device according to the present invention.

Referring to FIG. 1 the corona generator 10 of this invention is seen to comprise a corona discharge electrode 11 in the form of a conductive wire 12 having a relatively thick coating 13 of dielectric material.

A charge collecting surface 14 is shown which may be a photoconductive surface in a conventional xerographic systems. The charge collecting surface 14 is carried on a conductive substrate 15 held at a reference potential, usually machine ground. An AC voltage source 18 is connected between the substrte 15 and the corona wire 12, the magnitude of the AC source being selected to generate a corona discharge adjacent the wire 12. A conductive shield 20 is located adjacent the corona wire on the side of the wire opposite the chargeable surface.

The shield has coupled thereto a switch 22 which depending on its position, permits the corona device to be operated in either a charge neutralizng mode or a charge deposition mode. With the switch 22 as shown, the shield 20 of the corona device is coupled to ground via a lead 24. In this position, no DC field is generated between the surface 14 and the shield 15 and the corona device operates to neutralize over a number of AC cycles any charge present on the surface 14.

With switch 22 in either of the positions shown by dotted lines, the shield is coupled to one terminal of a DC source 23 or 27, the other terminals of the sources being coupled by lead 26 to ground thereby establish a DC field between the surface 14 and the shield 20. In this position, the corona operates to deposit a net charge onto the surface 14, the polarity and magnitude of this charge depends on the polarity and magnitude of the DC bias applied to the shield 20.

The corona wire 13 may be supported in conventional fashion at the ends thereof by insulating end blocks (not shown) mounted within the ends of shield structure 20. The wire 12 may be made of any conventional conductive filament material such as stainless steel, gold, aluminum, copper, tungsten, platinum or the like. The diameter of the wire 11 is not critical and may vary typically between 0.5–15 mil. and preferably is about 9 mils.

Any suitable dielectric material may be employed as the coating 13 which will not break down under the applied corona AC voltage, and which will withstand chemical attack under the conditions present in a corona device. Inorganic dielectrics have been found to perform more satisfactorily than organic dielectrics due to their higher voltage breakdown properties, and greater resistance to chemical reaction in the corona environment.

The thickness of the dielectric coating 13 used in the corona device of the invention is such that substantially no conduction current or DC charging current is permitted therethrough. Typically, the thickness is such that the combined wire and dielectric thickness falls in the range from 7–30 mil with typicl dielectric thickness of 2–10 mil. Glasses with dielectric breakdown strengths above 2 KV/mil at 4 KHz and in the range of 2 to 5 mil thickness have been found by experiment to perform satisfactorily as the dielectric coating material. As the frequency or thickness go down the strength in volts will usually increase. The glass coating selected should be free of voids and inclusions and make good contact with or wet the wire on which it is deposited. Other possible coatings are ceramic materials such as Alumina, Zirconia, Boron Nitride, Beryllium Oxide and Silicon Nitride. Organic dielectrics which are sufficiently stable in corona my also be used.

The frequency of the AC source 18 may be varied widely in the range from 60 hz. commercial source to several megahertz. The device has been operated and tested at 4 KHz. and found to operate satisfactorily.

The shield 20 is shown as being semi-circular in shape but any of the conventional shapes used for corona shields in xerographic charging may be employed. In fact, the function of the shield 20 may be performed by any conductive member, for example, a base wire, in the vicinty of the wire, the precise location not being critical in order to obtain satisfactory operation of the device.

With the switch 22 connected as shown so that the shield 20 is grounded, the device operates to inherently neutralize any charge present on the surface 14. This is a result of the fact that no net DC charging current passes through the electrode 11 by virtue of the thick dielectric coating 13 and the wire 12.

Referring to FIG. 1, operation of the corona device of the invention to deposit a specific net charge on an imaging surface is accomplished by moving switch 22 to one of the positions shown in dotted lines, whereby a DC potential of either positive polarity or negative polarity with respect to the surface 15 may be applied to the shield.

In charging operation typical AC voltages applied to the corona electrodes are in the range from 4 KV to 7 KV at a frequency between 1 KHz and 10 KHz. With the conductive substrate of the imaging member being held at ground potential a negative DC bias of from about 800 volts to about 4 KV is applied to the shield. For further details of the manner of oeration of the above described dicorotron device, attention is directed to U.S. Pat. No. 4,086,650 to Davis et al which is hereby incorporated in its entirety into the instant disclosure.

Referring once again to FIG. 1, the shield 20 has a substantially continuous thin layer 28 of lead plated on the interior thereof to neutralize the nitrogen oxide species that may be generated when the dicorotron is energized. The exact mechanism in which the lead plating neutralizes the nitrogen oxide is not fully understood. However it is believed the lead combines with the nitrogen oxides and forms lead nitrates in an irreversible reaction. Furthermore the lead nitrate has a low water solubility and therefore does not adsorb water from the atmosphere. Accordingly, the nitrogen oxides appear to be irreversibly bound in the form of lead nitrates which are not deliquescent. In order to form this irreversible neutralization of the nitrigen oxides, the lead plating should be sufficiently thick that it will not be consumed in a reasonable perid of time thereby limiting the operation of the device. Accordingly, it is preferred that the lead plating be at least about 0.5 mils in thickness which should give an operational life in excess of 500 hours. Furthermore, to insure that no nitrogen oxides are adsorbed and subsequently desorbed by the shield, the lead plating should be substantially continuous without pores. The lead plating may be obtained in any suitable way such as by vacuum deposition or electroplating. In the electroplating mode of operation it is preferable to provide an interface metal such as nickel or copper before the lead is electroplated to act as a diffusion barrier to protect the shield, which may be made of aluminum, from attack during the electroplating of the lead and to provide a smoother less porous surface for the electropalte. In addition to the lead being applied as an electroplated or vacuum deposition directly on the shield 20 it may be placed within the shield 20 in the form of a shaped insert to protect the shield.

Figure 2:
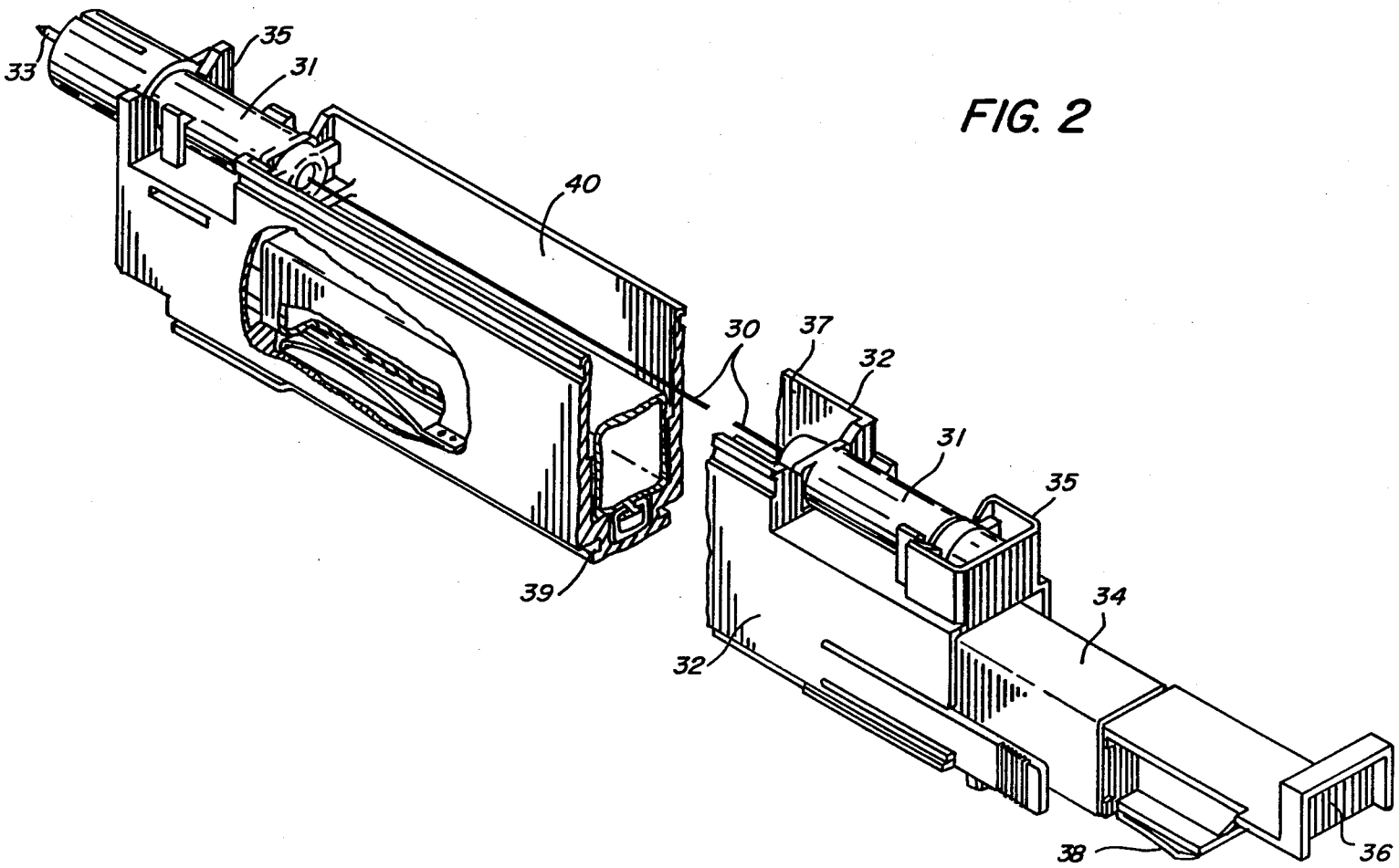
FIG. 2 is an isometric view of a preferred embodiment of a dicorotron according to the present invention.

FIG. 2 illustrates a preferred embodiment in the dicorotron device according to the present invention. In FIG. 2 the dicorotron wire 30 is supported between anchors 31 at opposite ends which are anchored in end blocks 35. The conductive shield 34 is constructed in tubular fashion in such a way as to be slideably mounted in the bottom of the housing 39 by means of handle 36. The shield is connected to the power supply through a sliding contact on its inner surface to a leaf spring which in turn is connected to a DC pin connector (not shown). The power supply potential may be positive, negative, or zero (grounded) depending on device function. It is fastened in place when inserted within the housing 39 by means of spring retaining member 38. When inserted in the machine high voltage contact pin 33 provides the necessary contact to the AC power supply. In addition to the conductive shield 34 the housing 39 comprises two vertically extending side panels 32 extending the entire length of the dicorotron wire. Both the top and inner surfaces of the shield 34 and the interior of the vertically extending panels 32 of the housing 39 are plated with lead 40 according to the practice of the present invention. The housing 39 together with the side panels 32 my be made from a single one piece molding from any suitable material such as glass filled polycarbonate. Instead of the plating being applied directly to the side panels 32 lead may be present there in the form of relatively thin strip inserts.

A comparative test was conducted with the device illustrated in FIG. 2. In the first sample dicorotron device without the lead platings and just employing the conductive shield made out of aluminum together with the single one piece molded housing from a glass filled polycarbonate material were used in the Xerox 1075 as a charging device for the production of about 10,000 copies. Thereafter the machine was shut down and rested overnight and operation resumed the next morning at which time a line deletion or drop in line image density was observed across that narrow portion of the photoreceptor which was opposite the dicorotron charging device during shut down. This was a result of lower surface charge density and a corresponding lower developed toner mass per unit area. This image deletion was repeated for each revolution of the photoreceptor.

To test the efficiency of the lead plating according to the present invention, a strip of lead was placed over the opening of the dicorotron charging device and exposed to negative corona for a period of about 1,000 hours. The lead plate was then removed at intervals of about 150 hours and placed adjacent to the same photoreceptor belt spaced apart by about 0.06 inches for about one hour after which the photoreceptor was charged and exposed with no deletion problem being experienced over that portion of the photoreceptor placed adjacent to the strip of lead. Even after the completion of 1,000 hours exposure to corona no deletion problem was experienced.

Figure 3:
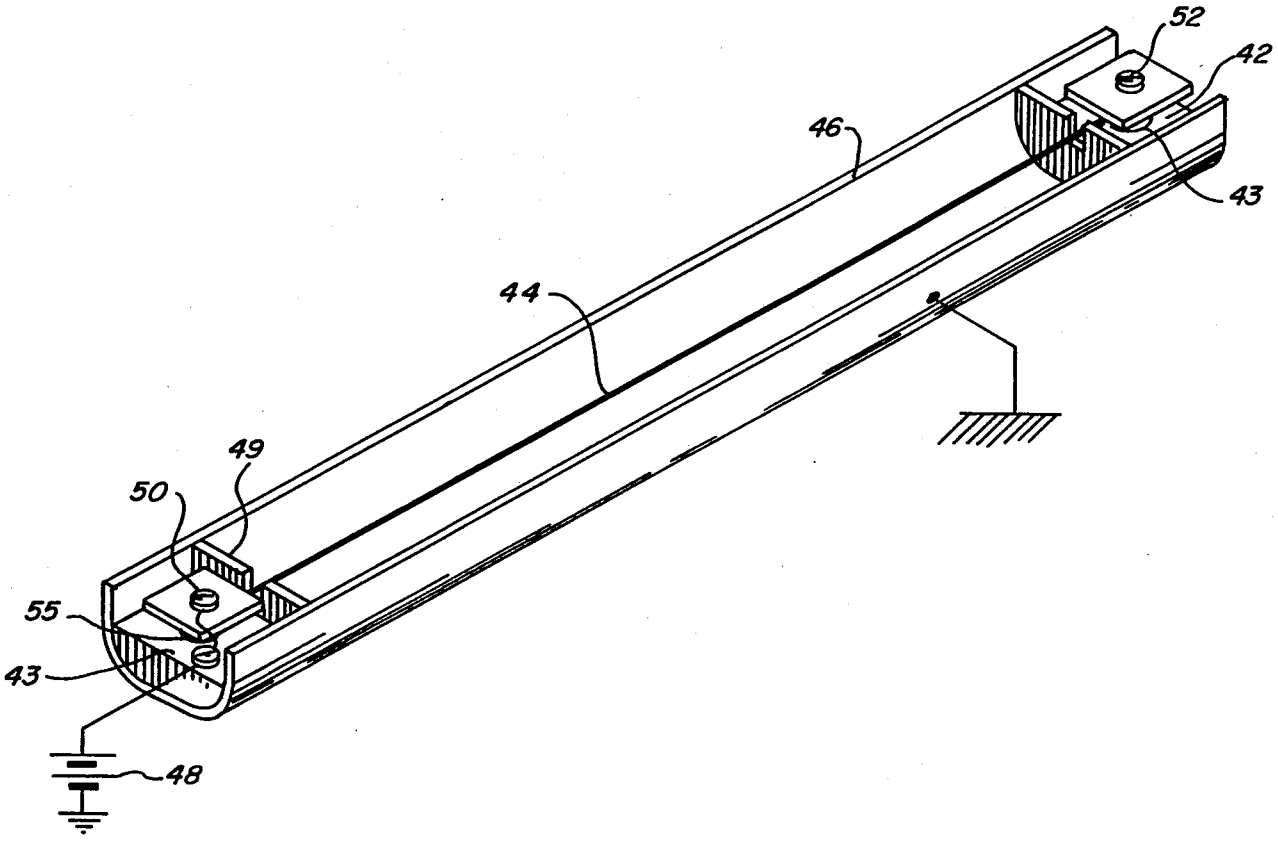
FIG. 3 is an isometric view of another preferred embodiment of corotron according to the present invention.

FIG. 3 illustrates an alternative embodiment according to the preent invention and in particualr is directed to a single wire corotron device wherein the wire 44 is supported between insulating end block assemblies 42 and 43. A conductive corotron shield 46 which is grounded increases the ion density available for conduction. Since no charge builds up on the shield the voltage between the shield and the wire remain constant and a constant density of ions is generated by the wire. The effect of the grounded shield is to increase the amount of current flowing to the plate. The corona wire 44 at one end is fastened to port 52 in the end block assembly and at the other end is fastened to port 50 of the second end block assembly. The wire 44 at the second end of the corona generating device is connected to the corona potential generating source 48 by lead 55. Such a device might have utility as an AC precharge corona generating device in which case the corotron shield 46 is plated with a thin layer of lead.

The dicorotron charging device and in particular that illustrated in FIG. 2 above may have application, for example, as the charging device in the machine concept described and illustrated in U.S. Pat. No. 4,318,610 to Grace.

As pointed out above the negative charging devices according to the present invention have the advantage of successfully neutralizing nitrogen oxides formed during the charging operation. While it is not fully understood it is believed that the lead combines with the nitrogen oxide in an irreversible reaction forming lead nitrates which do not adsorb water which can subsequently accumulate finally falling in droplet fashion to the surface of the photoreceptor. The lead plating has the advantage of being relatively inexpensive and remaining physically continuous on the plated surface. Furthermore it has the advantage in that it can be alloyed with up to about 20 to 25 percent by weight of another metal to improve the physical characteristics such as hardness and the appearance of the coating. For example, when alloyed with tin, the lead does not appear spongy and capable of being manually wiped off the surface.

All the patents and the article referred to herein are hereby incorporated by reference in their entirety into the instant specification.

While the invention has been described with reference to specific embodiments it will be apparent to those skilled in the art that many alternatives, modifications and variations may be made. For example, the grid in a conventional scorotron may be plated with lead when the scorotron has a negative DC potential or AC potential applied. Accordingly, it is intended to embrace such modifications and alternatives as may fall within the spirit and scope of the appended claims.

What is claimed is:

1. A corona generating device for depositing a negative charge on an imaging surface carried on a conductive substrate held at a reference potential comprising;

at least one elongated conductive corona discharge electrode supported between insulating end blocks, means to connect said electrode to a corona generating potential source, at least one element adjacent said corona discharge electrode capable of adsorbing nitrogen oxide species generated when said corona discharge electrode is energized and capable of desorbing nitrogen oxide species when said electrode is not energized, said at least one element being plated with a substantially continuous thin layer of lead to neutralize the nitrogen oxide species when generated.

2. The corona generating device of claim 1 wherein said plated layer of lead is at least about 0.5 mils in thickness.

3. The corona generating device of claim 1, wherein said at leat one element comprises a conductive shield which substantially surrounds said corona discharge electrode and has a longitudinal opening therein to permit ions emitted from the electrode to be directed toward the surface to be charged.

4. The corona generating device of claim 1, wherein said corona discharge electrode comprises a thin wire coated at least in the discharge area with a dielectric material, and said conductive shield has means associated therewith to connect to a potential source.

5. The corona generating device of claim 4, wherein said shield is planar on one side of the corona discharge electrode and further including an insulating housing having two sides adjacent said shield to define a longitudinal opening to permit ions emitted from the electrode to be directed toward a surface to be charged, said two sides of said insulating housing being plated with a substantially continuous thin layer of lead.

6. The corona generating device of claim 5, wherein said insulating housing includes two planar side elements which together with the shield enclose the corona discharge electrode on three sides.

7. The corona generating device of claim 4, wherein said dielectric material is glass.

8. The corona generating device of claim 6, further including power supply means for applying an A.C. corona generating voltage to said electrode and providing a D.C. potential between said substrate and said shield.

9. The corona generating device of claim 6, wherein said plated layer of lead is at least 0.5 mils in thickness on said shield and said two sides of said insulating housing.

10. The corona generating device of claim 9, wherein said dielectric material has a thickness sufficient to prevent the flow of net D.C. current through said wire.

11. The corona generating device of claim 2, wherein the lead is alloyed with up to about 25 percent by weight of tin.

12. The corona generating device of claim 9, wherein the lead is alloyed with up to about 25 percent by weight of tin.

13. The corona generating device of claim 1 wherein said one element has a diffusion barrier between it and the lead.

* * * * *